United States Patent [19]

Auclair et al.

[11] 4,106,287

[45] Aug. 15, 1978

[54] REDUCING POLLUTION FROM INTERNAL COMBUSTION ENGINES

[75] Inventors: Michel Auclair; Louis Le Parmentier, both of Mont-Saint-Aignan, France

[73] Assignee: Exxon Research & Engineering Co., Linden, N.J.

[21] Appl. No.: 654,480

[22] Filed: Feb. 2, 1976

[30] Foreign Application Priority Data

Feb. 3, 1975 [FR] France ..... 75 03198

[51] Int. Cl.[2] ..... F02B 75/10; F01N 3/10

[52] U.S. Cl. ..... 60/274; 60/282

[58] Field of Search ..... 60/282, 323, 285, 303, 60/274; 123/119 RL

[56] References Cited

U.S. PATENT DOCUMENTS

| | | | |
|---|---|---|---|
| 2,837,169 | 6/1958 | Sawyer | 60/303 |
| 3,635,031 | 1/1972 | Haddad | 60/323 |
| 3,768,260 | 10/1973 | Glenn | 60/282 |
| 3,785,153 | 1/1974 | Schwing | 60/303 |
| 3,791,144 | 2/1974 | Lang | 60/285 |
| 3,910,240 | 10/1975 | Omori | 60/276 |
| 3,927,525 | 12/1975 | Jacobs | 60/302 |
| 3,934,411 | 1/1976 | Masaki | 60/303 |

*Primary Examiner*—Douglas Hart
*Attorney, Agent, or Firm*—F. Donald Paris

[57] ABSTRACT

A multicylinder internal combustion engine is operated with one cylinder supplied with a fuel-rich charge and the other cylinder(s) with a lean or leaner charge so that the said one cylinder produces "rich" exhaust gas which is rich in combustible components and the other cylinder(s) produce "lean" exhaust gas which is lean in combustible components. Air is mixed with the exhaust gas from each cylinder, and the rich exhaust gas ignites. The rich exhaust gas is passed into one end of a cylindrical reactor and the lean exhaust gas into the remaining part of the reactor. A tubular member disposed concentrically within the reactor has one or more flame-trap orifices at or towards the said one end and is connected to an exhaust pipe at the other end. Burning rich exhaust gas passes through the flame trap orifices into the tubular member and entrains therewith lean exhaust gas causing combustion of combustible components therein. A stationary mixer within the tubular member ensures that the combustion is substantially complete, and also promotes heat exchange between the hot gases passing to the exhaust pipe and the exhaust gas in the reactor around the tubular member.

27 Claims, 3 Drawing Figures

REDUCING POLLUTION FROM INTERNAL COMBUSTION ENGINES

Figure 1:
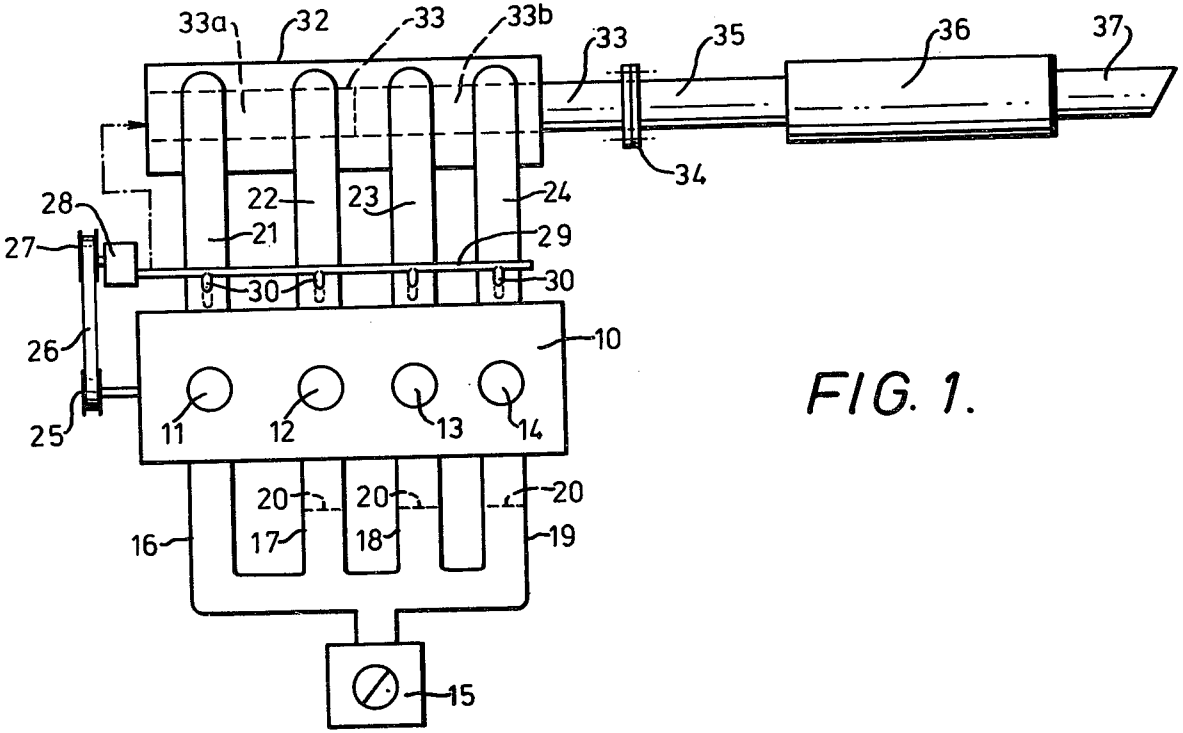

The present invention relates to reducing pollution from an internal combustion engine having a plurality of cylinders in each of which a piston reciprocates, and to apparatus for purifying exhaust gas from such an engine, and to such an engine adapted to discharge purified exhaust gas during operation.

Air pollution by exhaust gas from internal combustion engines, particularly the engines of automobiles is undesirable, and efforts have been made to reduce the amount of pollutant in the exhaust gas of internal combustion engines.

The raw exhaust gas discharged from an internal combustion engine contains, inter alia, carbon monoxide (CO), and unburned and partially burned hydrocarbons (herein collectively designated "HC's"). It is known that at least some of the CO and HC's in raw exhaust gas can be oxidized to carbon dioxide and steam by mixing the raw exhaust gas with an oxygen-containing gas (usually air) at elevated temperatures. Thus oxidation is usually performed in a reactor located between the exhaust manifold and the silencer, the reactor serving to provide good mixing of the exhaust gas and oxygen-containing gas and an adequate residence time at oxidation-promoting temperatures.

Heretofore, the oxygen-containing gas has been mixed with the raw exhaust gas at the outlet of each exhaust port of the engine so that the reactor receives ignited exhaust gas from each cylinder, and the combustion of CO and HC's in the mixture of exhaust gas discharged from all the cylinders proceeds in the reactor. In order that the CO and HC's can be ignited, and the resulting combustion be sustained, the raw exhaust gases from all of the cylinders must contain at least an ignitable amount of combustible material, even at the highest exhaust gas temperatures normally encountered. Usually, the raw exhaust gas from each cylinder has a CO content of from 6 to 8 vol % or higher and it is evident that a raw exhaust gas having a CO content in such concentrations is produced by burning in the cylinders of the engine a fuel and air mixture that is relatively rich in fuel, assuming that the engine is correctly adjusted for ignition timing and for the discharge of the raw exhaust gases from the cylinders. During idling or under low road, the fuel/air ratio is usually arranged to be from 1.15 to 1.30 times the stoichrometric ratio, and there is accordingly a relatively large increase in fuel consumption.

An object of the present invention is to provide a method and apparatus for reducing the amount of pollutant in exhaust gas from an internal combustion engine with the combustion of less fuel than by the expedients of the prior art described above.

In one aspect, the present invention provides a method of reducing pollution from an internal combustion engine having a plurality of cylinders in each of which a piston reciprocates, the method comprising burning in one cylinder a fuel-air mixture which produces rich exhaust gas containing sufficient combustible matter to be combustible when mixed with oxygen-containing gas, and burning in the other cylinder(s) a fuel-air mixture which produces lean exhaust gas containing insufficient combustible matter to be combustible when mixed with oxygen-containing gas, conducting the rich and lean exhaust gas into respective communicating regions of a reactor having an outlet zone communicating with an exhaust discharge aperture, mixing oxygen-containing gas with the rich and lean exhaust gas whereby combustible matter in the rich exhaust gas will burn and thereby promote the combustion of combustible matter in the lean exhaust gas where the rich and lean exhaust gas contact each other, and discharging exhaust gas depleted in combustible matter via the outlet zone and the exhaust discharge aperture.

Preferably, thorough mixing of the rich and lean exhaust gas is promoted in the outlet zone, and it is preferred that the exhaust gas speed in the outlet zone is lower than the speed of propagation of combustion of combustible matter in the exhaust gas passing therethrough.

At least some of the oxygen-containing gas may be added to the rich and lean exhaust gas before entry to the reactor, and this oxygen-containing gas may be added in the vicinity of, or by injection into, exhaust ports of the engine cylinders.

The rich exhaust gas may contain at least 5 vol % CO and may contain up to 8 vol % CO. The lean exhaust gas may be produced by burning in the other cylinder(s) of the engine a fuel-air mixture which produces, overall, substantially smooth engine operation — e.g. operation without "hunting" or an unacceptable amount of hunting.

The overall or mean composition of the rich and lean exhaust gas (i.e. the composition obtained by mixing the rich and lean exhaust gases) may be substantially the same as, or leaner than, the overall or mean composition of exhaust gas produced by supplying the cylinders with a substantially uniform fuel and air mixture producing substantially smooth engine operation.

The fuel-air mixture burned to produce the lean exhaust gas may comprise from 1.00 to 1.05 the stoichrometric proportion of fuel. The mixture burned in the said one cylinder to produce the rich exhaust gas may comprise from 1.15 to 1.30 times the stoichiometric proportion of fuel.

Preferably, the outlet zone is in heat transfer relationship with the said communicating regions of the reactor whereby some heat is transferred from the exhaust gas in the outlet zone to exhaust gas in one or more of the said communicating regions of the reactor.

In another aspect, the invention provides apparatus for purifying exhaust gas from an internal combustion engine having a plurality of cylinders in each of which a piston reciprocates, the apparatus comprising a hollow reactor surrounding, and spaced apart from, a hollow tubular member which extends, within the reactor, from one end of the reactor to at least half way towards the other end, the tubular member being adapted to function as a flame trap and having an exhaust discharge orifice at one end at least at the said one end of the reactor and at least one exhaust entrance orifice at least in the vicinity of the other end within the reactor, a plurality of exhaust conduits attached to the reactor body at spaced apart locations and adapted for conducting gas from each cylinder to the interior of the reactor, and means preventing the escape of exhaust gas from within the reactor except through the tubular member.

Preferably, the reactor and tubular member are of circular cross-section and substantially concentric, and preferably, the exhaust conduits are attached substantially tangentially to the reactor body so as to promote gas circulation therein around the interior of the reactor.

The diameter of the reactor may be from 1.5 to 3.0 times that of the tubular member.

There may be an exhaust pipe attached to the tubular member for receiving exhaust gas from the exhaust discharge orifice thereof, the exhaust pipe being of substantially the same diameter as the tubular body.

The tubular member may extend within the reactor as far as the said other end thereof, the said exhaust entrance orifice(s) being in the peripheral wall of the tubular member adjacent to the said other end of the reactor.

The exhaust entrance orifice(s) may have an area of from 45% to 200% of the cross-sectional area of the tubular member. A dimension of the or each exhaust orifice is preferably of sufficiently small size that the or each orifice forms a flame trap.

In one preferred embodiment, the exhaust entrance orifice comprises at least one slot extending lengthwise of the tubular member. The slot(s) may have a width in the range of from 3 to 10 mms.

There is preferably provided stationary mixing means to promote gas mixing within the tubular member. Such mixing means is preferably within the tubular member at least in the region of the exhaust entrance orifice(s) and may comprise at least one element which is of helical or twisted form lengthwise of the tubular member. The helical or twisted element may comprise at least two twisted or helical blades arranged end-to-end with contiguous ends substantially perpendicular to each other.

The exterior of the reactor is preferably lagged to reduce heat losses therefrom.

In a further aspect, the invention provides an internal combustion engine having a plurality of cylinders in each of which a piston reciprocates, the cylinders having intake ports and exhaust ports, air intake means for conducting air to the intake ports of the cylinders, fuel supply means for supplying fuel to the cylinder to form, with air from the air intake means, a combustible fuel-air mixture in the cylinders and for ensuring that the mixture supplied to one cylinder is richer than the mixture supplied to the other cylinder(s), apparatus as described in the preceding paragraphs having an exhaust conduit disposed for receiving exhaust gas from each exhaust port, and means for supplying oxygen-containing gas to the interior of the apparatus. Preferably, the volume enclosed by the walls of the reactor is substantially equal to the expanded volume of gas from the cylinder of the engine.

The fuel supply means may be so constructed and arranged that the fuel/air ratio in the said one cylinder is from 1.15 to 1.30 times the stoicheometric ratio, and the fuel/air ratio in the other cylinder(s) is from 1.00 to 1.05 times the stoicheometric ratio. Various expedients apparent to those skilled in the art may be employed alone or in combination to supply fuel and air at different proportions to the said one and the said other cylinders. Thus, in fuel injection engines, the stroke of the fuel injector supplying the said one cylinder may be greater than the stroke of the injector(s) supplying the other cylinder(s). In engines employing a single carburetor for the cylinders or for a single bank of cylinders, the intake manifold pipes may have suitable weirs and/or restrictions and/or baffles to restrict the passage of fuel to the said other cylinder(s), and/or there may be upward gradients and/or bends in the manifold pipes supplying these cylinders so that the said one cylinder receives a richer mixture than the other cylinder. The said one cylinder may be supplied with fuel or a supplementary amount of fuel from another carburetor.

The oxygen-containing gas is preferably air and is conveniently furnished from a f an or pump driven by the engine. The air may be injected into the exhaust ports of the engine and/or into the vicinity thereof from respective air tubes extending through the exhaust conduits and/or from orifices in the peripheral wall of each exhaust conduit in the immediate vicinity of the corresponding engine exhaust port. Some oxygen-containing gas may be passed into the reactor.

Figure 2:
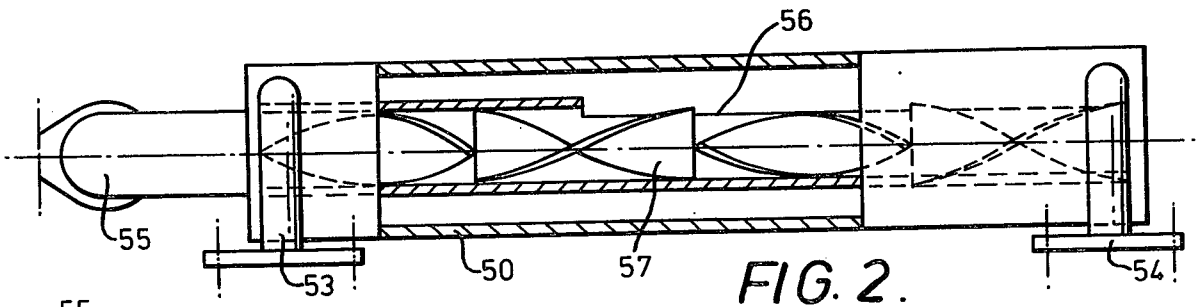
Figure 3:
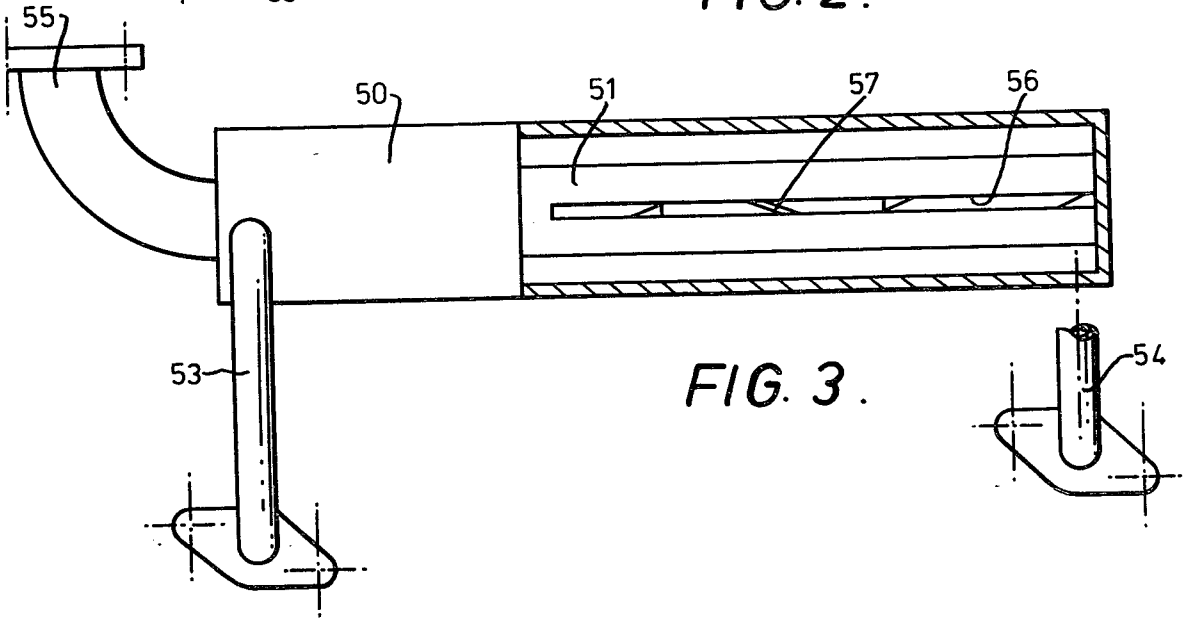

The invention will now be illustrated by reference to the accompanying drawings which relate to non-limitative examples of the invention and wherein:

FIG. 1 is a plan diagrammatic view, not to scale, of part of an internal combustion engine according to the invention, FIG. 2 is a plan diagrammatic view of apparatus according to the invention, partly broken open to show the internal arrangement, and FIG. 3 is a side diagrammatic view of the apparatus of FIG. 2, also partly broken away.

Reference is first made to FIG. 1 which shows an engine block 10 having four in-line cylinders 11, 12, 13, 14 which are supplied with a fuel air mixture from a carburetor 15 via respective intake manifold pipes 16, 17, 18 and 19. Pipes 17, 18 and 19 incorporate baffles or weirs indicated by reference 20 to reduce the flow of fuel droplets and agglomerated fuel droplets to the cylinders 12, 13 and 14 so that the fuel air mixture reaching these cylinders is relatively lean. The pipe 16 is free of the baffles or weirs 20 provided for the purpose of leaning out the fuel-air mixture so that the fuel-air mixture reaching cylinder 11 is relatively fuel-rich. During engine operation, the fuel-air mixture in each of the cylinders is ignited by any of the known techniques (e.g., electric spark) and a "rich" exhaust gas (i.e. an exhaust gas containing a relatively high proportion of combustible matter) passes out of the cylinder 11 via its exhaust port (not shown) to its exhaust conduit 21, while lean exhaust gas (i.e. exhaust gas which is relatively poor, or even devoid, of combustible matter) passes out of cylinders 12, 13 and 14 into their respective exhaust conduits 22, 23 and 24. The operation of the engine drives a pulley wheel 25 which is connected by a belt 26 to drive a pulley wheel 27 operating an air supply impeller of an air pump 28. Air leaves the air pump 28 via duct 29, and is passed via respective tubes 30 into, or towards, the exhaust ports of the engine. The tubes 30 extend through the exhaust conduit walls and are sloped or turned at their ends so as to be close to, and to direct air therefrom, into or towards the exhaust ports. As the exhaust gas temperature in the vicinity of the ports there is combustion of combustion matter in the rich exhaust gas in conduit 21 and there may be some combustion in the lean gas of conduits 22, 23 and 24.

The exhaust conduits 21–24 are connected, remote from the engine block 10, tangentially or circumferentially to a hollow cylindrical reactor 32 so that the exhaust gases circulate circumferentially but tend to be stratified to some extent lengthwise of the reactor 32 into lean exhaust gas layers towards the end at which conduit 24 is connected and rich exhaust gas layers towards the other end where conduit 21 is connected.

Concentrically disposed within reactor 32 is a tube 33 of circular cross-section which extends from one end of the reactor 32 to the other end, and is connected, (e.g.

by a flange joint 34) to an exhaust pipe 35 which in turn is connected to a silencer or muffler 36 which discharges exhaust gas to atmosphere via tail pipe 37.

The reactor 32 is surrounded by lagging (not shown) to prevent heat loss, and it will be appreciated that the exhaust gas within the tube 33 is in heat exchange relationship with exhaust gas surrounding it in the reactor.

The upstream section 33*a* of tube 33 has one or more apertures (not shown) therethrough, while the downstream section 33*b* is not so apertured in its peripheral wall. The apertures may be of any shape, e.g. circular, slot-like, etc., provided that they act as a flame trap. Accordingly, the or each aperture should have at least one dimension of preferably between 2 and 10 mms. The circulation of rich, burning, exhaust gas in the reactor 32 around the tube 33 and radially through the aperture(s) into the tube 33 causes entrainment of lean exhaust gas from the reactor 32, and the burning hot rich gas mixes with the lean oxygen-containing exhaust gas and promotes combustion of combustible matter therein. The combustion flame is substantially maintained in the annular space between the wall of the reactor 32 and the tube 33 and is substantially prevented from passing into the tube 33 by the flame-trapping action of the aperture(s) of section 33*a*. The stratification of the rich and lean exhaust gas in the reactor 32 ensures that lean gas cannot pass out of the reactor 33 without encountering hot, burning rich gas when the cylinder 11 is at its exhaust stroke or the hot burned residue thereof when the cylinder 11 is not at its exhaust stroke, so that combustible matter in the lean exhaust gas tends to be ignited.

The thus burned and thereby purified and heated exhaust gas passes through tube 33 to the exhaust pipe 35, and gives up some of its heat content to the exhaust gas in the reactor 33, thereby improving the ignitability of the leaner exhaust gas during its passage through the reactor. There may be means for promoting mixing of the exhaust gas passing through the tube 33 to enhance heat exchange through the wall of the tube 33 and to complete oxidation of combustible matter in the tube.

Thus, the exhaust gas from the engine may be substantially purified of CO and HC's while operating only one of the cylinders on a relatively fuel rich mixture.

The section 33*a* of tube 33 may extend for up to 75% or more of the length of the tube 33. In embodiments wherein the or each aperture in tube 33 is a slot formed lengthwise of the tube 33, the section 33 may extend up to about 67% of the length of the tube 33. An embodiment of this type is now described with reference to FIGS. 2 and 3 wherein the reactor is adapted for use with a two cylinder engine of the flat twin type, and is specifically for use on a gasoline engine of 600 $cm^3$ capacity used in mass-produced vehicles.

In FIGS. 2 and 3 the reactor 50 is a hollow cylinder of axial length 45 cms and inner diameter 8 cms in which is concentrically disposed a cylindrical tube 51 which extends the whole length of the reactor 50 and has an inside diameter of 4 cms.

Two exhaust gas conduits 53, 54 are connected to the reactor substantially tangentially or peripherally so as to direct exhaust gas from the engine (not shown) substantially tangentially into the annular volume surrounding the tube 51 at separated regions. One end 55 of the tube 51 is connected or connectible to an exhaust pipe, while the other end has a slot 56 formed in the wall thereof lengthwise of the tube 51. The slot is 15 cms long and about 0.4 cms wide. Within the tube 51 is disposed a stationary gas mixer 57 comprised of helical or twisted blades or vanes. As depicted, there are four such blades or vanes arranged end-to-end, contiguous ends being perpendicular to each other, each blades or vane being formed from thin metal sheet of the same width as the internal diameter of the tube 51 and twisted lengthwise of the tube 51.

The reactor, tube and mixer are made from refractory stainless steel, and lagged in a quartz wool jacket (not shown).

One of the cylinders of the engine is arranged to run fuel-rich (about 1.20 × stoichiometric) and the other is arranged to run with a stoichiometric fuel-air mixture. The rich exhaust gas from the fuel-rich cylinder is conducted to the reactor 50 via conduit 54 and the lean exhaust gas is conducted to the reactor via conduit 53. Air is injected into each exhaust port from an engine driven pump substantially in the manner described in relation to FIG. 1. The settings of the carburetor and ignition timing were unaltered in a series of tests, the results of which are briefly summarized below. The tests were in accordance with the method described in Regulation 15 of the European Economic Community as published in the Journal Official de la Republique Française, May 17th, 1969, by order dated 31 March 1969. The test vehicle was run on a test-bench after a cold start, and followed a standardized sequence of different operating conditions which sequence was repeated four times. Samples of exhaust gas were collected 33 seconds after starting the vehicle and continued during the four sequences. The carbon monoxide and hydrocarbons in the exhaust gas were determined, and the table below gives the average weight in grams of the pollutants.

| Pollutant | CO | HC |
|---|---|---|
| Original Vehicle | 98 | 6.7 |
| Vehicle according to invention | 20 | 1.5 |

It will be seen that there was a substantial reduction in the pollutant level of the engine without changing any of the engine operating characteristics. This contrasts markedly with known types of post-combustion reactors in which the carburettor setting must be changed to produce richer exhaust gas, thereby increasing fuel consumption.

What we claim is:

1. A method for reducing pollution from an internal combustion engine having a plurality of cylinders each of which includes a reciprocating piston, in combination with a reactor for the combustion of exhaust which flows in a downstream direction from said engine, said reactor having an outlet zone communicating through flame trap means with an exhaust discharge aperture wherein said flame trap means retains the flame of burning gas upstream thereof, the method comprising: burning in one cylinder a fuel-air mixture for producing a rich exhaust gas containing sufficient combustible matter for combustion when mixed with oxygen-containing gas; burning in the other of said cylinders a fuel-air mixture for producing a lean exhaust gas containing insufficient combustible material for combustion when mixed with oxygen-containing gas; conducting said rich exhaust gas into a first communicating region within said reactor adjacent said flame trap means to form a stratum of burning rich exhaust gas; conducting said lean exhaust gas into a second communicating region within said reactor located in a direction downstream from said first communication region in the direction of flow of said exhaust from said flame trap to said exhaust discharge aperture; exhausting said lean exhaust gas through said discharge aperture including passing said lean exhaust gas through said first communicating region in contact with said stratum of burning rich exhaust gas; mixing oxygen-containing gas with said rich and lean exhaust gases for combusting said combustible material in said rich exhaust gas and enhancing combustion of said combustible material in said lean exhaust gas; and thereafter discharging exhaust gas substantially depleted of combustible material through said outlet zone and said exhaust discharge aperture.

2. A method as in claim 1 including directing each of said rich and lean exhaust gas stream in a substantial tangential direction from said engine into their respective first and second communicating regions in said reactor.

3. A method as in claim 1 including the step of: passing said contacted exhaust gases through a mixing zone in said exhaust passageway for ensuring substantially complete combustion and promoting heat exchange between hot gases being exhausted from said reactor and the exhaust gas from said engine which is disposed in the vicinity of said mixing zone in said reactor.

4. A method as in claim 1 comprising thoroughly mixing the rich and lean exhaust gas in said outlet zone of said reactor.

5. A method as in claim 1 including adding at least some of the oxygen-containing gas to the rich and lean exhaust gas before entry into the reactor.

6. A method as in claim 5 including adding said oxygen-containing gas to the exhaust gas in the vicinity of exhaust ports from said engine.

7. A method as in claim 1 in which the rich exhaust gas contains at least 5 vol. % CO.

8. A method as in claim 1 in which the rich exhaust gas contains up to 8 vol. % CO.

9. A method as in claim 1 in which the overall composition of the rich and lean exhaust is substantially the same as the overall composition of exhaust gas produced by supplying the cylinders with a substantially uniform fuel and air mixture which produces substantially smooth operation of the engine.

10. A method as in claim 1 in which the fuel-air mixture burned in said other of said cylinders comprises from 1.00 to 1.05 times the stoichiometric proportion of fuel.

11. A method as in claim 1 in which the fuel-air mixture burned in the said one of said cylinders comprises from 1.15 to 1.30 times the stoichiometric proportion of fuel.

12. A method as in claim 1 including disposing the outlet zone in heat transfer relationship with at least said second communicating region of the reactor for transferring heat from the exhaust gas in the outlet zone to exhaust gas in said second communication region of the reactor.

13. Apparatus for purifying exhaust gas from an internal combustion engine having a plurality of cylinders each of which includes a reciprocating piston, said apparatus comprising: a substantially hollow reactor surrounding and spaced from a substantially hollow tubular member; said tubular member disposed within said reactor and extending from one end thereof at least half way toward said other end of said reactor, said tubular member including flame trap and exhaust discharge orifice means at least at said one end of said reactor and an exhaust discharge conduit connected with said tubular member at said other end of said reactor; a plurality of exhaust conduits connected to said reactor at spaced apart locations for conducting rich and lean gas from said cylinders of said engine to the interior of said reactor; said orifice at said one end and said exhaust discharge conduit at said other end of said reactor comprising the passageway through which all exhaust gas within said reactor passes for exhaust to the atmosphere.

14. An internal combustion engine for producing rich and lean exhaust gas having a plurality of cylinders each of which includes a reciprocating piston, said cylinders having intake and exhaust ports, air intake means for conducting air to said intake ports of said cylinders, and fuel supply means for supplying fuel to the said cylinders to form, with the air from said air intake means, a combustible fuel-air mixture in said cylinders and for ensuring that the mixture supplied to at least one of said cylinders is richer than the mixture supplied to at least one other of said cylinders, a hollow reactor having an exhaust discharge aperture at one end, an outlet zone in communication with said discharge aperture and extending within the reactor at least partly toward the other end thereof, said outlet zone having flame trap means disposed towards said other end, means for conducting exhaust gas from said cylinders to respective communicating regions within said reactor, said conducting means being arranged for conducting rich exhaust gas from said one cylinder to a first of said communicating regions adjacent said other end of said reactor and lean exhaust gas from at least said other cylinder to a second communicating region between said first region and said one end of said reactor, said communicating regions arranged relative to each other and said flame trap means so that the lean exhaust gas from said others of said cylinders must pass through said first communicating region containing the rich exhaust gas for discharge from said reactor via said outlet zone and exhaust discharge aperture, and means for supplying oxygen-containing gas to the interior of said reactor.

15. An internal combustion engine according to claim 14 including mixing means in said outlet zone for promoting uniformity of mixing of the exhaust gas passing through the outlet zone to the discharge aperture.

16. Apparatus as in claim 13 in which the reactor and tubular member are of circular cross-section and disposed in substantially concentric relationship.

17. Apparatus as in claim 13 in which the exhaust conduits are attached substantially tangentially to the reactor.

18. Apparatus as in claim 16 in which the diameter of the reactor is from 1.5 to 3.0 times that of the tubular member.

19. Apparatus as in claim 16 comprising an exhaust pipe attached to the tubular member for receiving exhaust gas from the exhaust discharge orifice thereof, the exhaust pipe being of substantially the same diameter as the tubular body.

20. Apparatus as in claim 13 in which the tubular member extends within the reactor to substantially said other end thereof, exhaust entrance orifice means for said exhaust discharge conduit disposed in the peripheral wall of the tubular member adjacent to the said other end of the reactor.

21. Apparatus as in claim 20 in which the exhaust entrance orifice means has an area of from 45 to 200% of the cross-sectional area of the tubular member.

22. Apparatus according to claim 20 in which said exhaust entrance orifice means is of sufficient size to form a flame trap.

23. Apparatus according to claim 13 in which the exhaust entrance orifice means comprises at least one slot extending lengthwise of the tubular member.

24. Apparatus according to claim 13 comprising mixing means within the tubular member at least in the region of the exhaust discharge orifice means and extending lengthwise of the tubular member for promoting uniformity of mixing of the exhaust gas passing through the tubular member to the exhaust gas discharge conduit.

25. An internal combustion engine according to claim 14 in which the fuel supply means is so constructed and arranged that the fuel/air ratio in said one of said cylinders is fixed at a value of from 1.15 to 1.30 times the stoichiometric ratio, and the fuel/air ratio in the other of said cylinder is fixed at a value of from 1.00 to 1.05 times the stoichiometric ratio.

26. Apparatus for purifying a mixture of rich and lean exhaust gas from an internal combustion engine having a plurality of cylinders each of which includes a reciprocating piston, for burning air fuel mixtures of differing compositions to produce rich and lean exhaust gas, said apparatus comprising; a substantially hollow reactor surrounding and spaced from a substantially hollow tubular member; said tubular member disposed within said reactor and extending from one end thereof at least half way toward said other end of said reactor, said tubular member including flame trap and exhaust discharge orifice means at least at said one end of said reactor and an exhaust discharge conduit connected to said tubular member at said other end of said reactor; mixing means within said tubular member at least in the region of said exhaust discharge orifice means and extending lengthwise of said tubular member and comprising at least one twisted element which extends substantially the complete length of said tubular member between said one end and said other end; a plurality of exhaust conduits connected to said reactor at spaced apart locations for conducting said rich and lean gas from said cylinders of said engine to the interior of said reactor; said orifice means at said one end and said exhaust discharge conduit at said other end of said reactor comprising the passageway through which all exhaust gas within said reactor passes for exhaust to the atmosphere.

27. Apparatus for purifying a mixture of rich and lean exhaust gas from an internal combustion engine having a plurality of cylinders each of which includes a reciprocating piston, for burning and air fuel mixtures of differing compositions to produce rich and lean exhaust gas, said apparatus comprising; a substantially hollow reactor surrounding and spaced from a substantially hollow tubular member; said tubular member disposed within said reactor and extending from one end thereof at least half way toward said other end of said reactor, said tubular member including flame trap and exhaust discharge orifice means at least at said one end of said reactor and an exhaust discharge conduit connected to said tubular member at said other end of said reactor; mixing means within said tubular member at least in the region of said exhaust discharge orifice means and extending lengthwise of said tubular member and comprising at least two twisted blades arranged in end to end relationship with continuous ends substantially perpendicular to each other; a plurality of exhaust conduits connected to said reactor at spaced apart locations for conducting said rich and lean gas from said cylinders of said engine to the interior of said reactor; said orifice means at said one end and said exhaust discharge conduit at said other end of said reactor comprising the passageway through which all exhaust gas within said reactor passes for exhaust to the atmosphere.

* * * * *